United States Patent [19]

Davis et al.

[11] Patent Number: 4,461,531

[45] Date of Patent: Jul. 24, 1984

[54] SOCKET CONTACT FOR ELECTRICAL CONNECTOR AND METHOD OF MANUFACTURE

[75] Inventors: Alan L. Davis, Unadilla; Stephen Punako, Bainbridge, both of N.Y.

[73] Assignee: Bendix/Allied Corporation, Southfield, Mich.

[21] Appl. No.: 421,605

[22] Filed: Sep. 22, 1982

[51] Int. Cl.[3] ..... H01R 13/12

[52] U.S. Cl. ..... 339/258 R; 339/276 T

[58] Field of Search ..... 339/258 R, 258 P, 262, 339/276 T

[56] References Cited

U.S. PATENT DOCUMENTS

| | | | |
|---|---|---|---|
| 2,813,257 | 11/1957 | Cornell, Jr. | 339/262 R |
| 3,003,135 | 10/1961 | Purinton | 339/258 R |
| 3,145,069 | 8/1964 | Damon et al. | 339/218 |
| 3,170,752 | 2/1965 | Van Horssen | 339/258 R |
| 3,286,222 | 11/1966 | Drinkwater | 339/258 |
| 3,564,487 | 2/1971 | Upstone et al. | 339/258 R |
| 4,072,394 | 2/1978 | Waldron et al. | 339/276 T |

*Primary Examiner*—Joseph H. McGlynn

*Attorney, Agent, or Firm*—J. R. Benefiel; R. J. Eifler

[57] ABSTRACT

A socket contact (50) for electrical connectors and method of manufacture is disclosed comprised of a separate solid socket body (10) formed with a terminal portion (14), and a projection (16) receiving a tubular spring member (28). The projection (16) has a forward larger diameter section (20) with an intermediate groove (22), and a reduced diameter section (26). The spring member (28) has a circumferential crimp (38) seated in the intermediate groove (22) at assembly. Both the spring member (28) and an outer guide sleeve (40) have their rear ends (30, 46) crimped into the reduced diameter section (26) to establish a mechanical assembly thereto. The circumferential crimp (38) seated in the groove (22) enhances the electrical connection between the spring member (28) in the socket body (10) as well as aiding in assembly.

4 Claims, 3 Drawing Figures

SOCKET CONTACT FOR ELECTRICAL CONNECTOR AND METHOD OF MANUFACTURE

This invention relates to socket contacts for electrical connectors and a method of manufacture thereof.

This invention more specifically relates to socket contacts of the type including a conductive tubular spring member which is adapted to receive a mating pin, and a socket terminal electrically connected to the spring member and adapted to be connected to an electrical conductor. Such socket contacts are installed in an electrical connector by means of a retention shoulder molded or otherwise mechanically engaged to secure the contact in a connector plug. A guide sleeve is received over the spring member to provide an entrance guide for the mating pin contact and to limit the outward radial deflection of the spring member upon insertion of the pin contact.

The tubular spring member is typically provided by a series of slots extending into the forward end of the spring member to form a plurality of spring fingers, the spring fingers prestressed or otherwise formed to converge radially, enabling a pressure to be exerted on a contact pin upon insertion to insure a good electrical connection and to provide a retention force.

Such socket contacts have heretofore been manufactured from a solid stock material, as by machining, casting, etc. to provide an integral spring finger-socket terminal component. A separate guide sleeve is subsequently installed over a spring fingers.

The socket terminal is provided with a socket adapted to receive the bared end of an electrical conductor and crimped or soldered to establish a mechanical and electrical connection. Such crimped connection makes it desirable that this portion be constructed of relatively ductile material. On the otherhand, the spring member fingers should desirably be constructed of a highly resilient material such as berylium copper to prevent overstressing and yielding of the spring fingers. Such overstressing could reduce the spring force able to exerted upon insertion of the pin contact. Similarly, these respective portions thereof may be desirably plated with different plating processes or materials to minimize the contact resistance of the fingers and improve the resistance of the socket to environmental conditions.

A prior art two piece socket contact construction is disclosed in U.S. Pat. No. 3,286,222 to Drinkwater issued on Nov. 15, 1966 for "Prestressed Electrical Contact" which employs a separate machined socket body and formed spring member. This enables each component to be made of optimal materials and plating.

Machining such socket contacts is also relatively costly, and with large numbers of very small socket contacts being employed in typical electrical connectors, this higher cost involved in the machining of the contacts is quite significant.

Accordingly, there has heretofore been proposed and used a socket contact in which is comprised of formed or drawn sheet metal components with a contact liner sleeve and outer guide sleeve and a rear sleeve which is adapted to be joined to the electrical conductor. Either the rear sleeve or the guide sleeve is formed with the retention shoulder or flange in this construction. An example of such socket contact construction is shown in U.S. Pat. No. 4,072,394 to Waldron, et al issued on Feb. 7, 1978, for "Electrical Contact Assembly".

In this construction, the retention shoulder must be created by a forming process, and it has been found difficult to accurately form such a retention shoulder by forming processes, and the resulting shoulder is of less strength and stiffness than shoulders formed from solid stock. Also, the assembly of such contacts is relatively complex, offsetting a portion of the cost savings realized by use of the formed components.

In U.S. Pat. No. 3,564,487 to Upstone, et al issued on Feb. 16, 1971, for "Contact Member for Electrical Connector" there is disclosed an alternative construction in which a separate machined socket body is provided and a separate tubular spring member and a guide sleeve are assembled to a projection on one end of the socket body opposite the end receiving the electrical conductor. In this approach however, a reliable mechanical and electrical connection of the spring member guide sleeve and socket body is not ensured.

DISCLOSURE OF THE INVENTION

Accordingly, the present invention provides a socket contact construction and method of manufacture thereof for electrical connectors which provides a separate socket contact body and spring member components to enable optimal materials and plating to be employed for each of these components and also provide an accurately located, high strength retention shoulder, while allowing low cost assembly and highly reliable mechanical and electrical connections of the components.

The present invention comprises an improved socket contact for an electrical connector, and method of manufacture thereof which is comprised of a solid socket body, and having at one end a terminal portion. At the other end, the socket body has a projection having a relatively large diameter section at its outer end, adjacent to a relatively reduced diameter section.

A tubular spring member, is fit over the large diameter section and extended over the reduced diameter section. The guide sleeve is received over the spring member with its rear and even with the rear end of the tubular spring member. Each of the sleeves is crimped radially inwardly towards the reduced diameter section to achieve secure mechanical retention and a reliable electrical connection between the tubular spring member and the socket body.

According to a further aspect of the present invention, an intermediate groove in the socket body is interfit with a crimp in the tubular spring member to provide an axial securement of the tubular spring member on the projection for ease in assembly of the spring member to the socket body, and also to further improve the electrical connection between the socket body and the tubular member.

In the process of manufacture, both the guide sleeve and tubular spring member are first-assembled to the socket body and thereafter simultaneously crimped to simplify the manufacture.

This construction and method of manufacture has the advantage of employing a separate socket body and spring member to in turn allow optimal materials and platings to be employed for these respective components, while at the same time providing a strong, accurately located retention shoulder, without involving complex assembly operations in manufacturing the socket contact.

The present invention also has the advantage of providing reliable and highly secure mechanical and electrical connections between the socket body, the tubular spring member and the outer guide sleeve.

DETAILED DESCRIPTION

The present invention contemplates construction of such a socket contact as described comprising a separate socket body, a tubular spring member and an outer guide sleeve.

Figure 1:
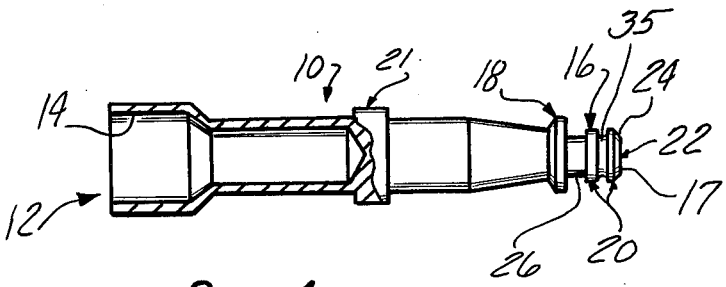
FIG. 1 is a partially sectional view of a socket body component formed according to the teachings of the present invention.

FIG. 1 depicts the socket body 10 which is formed from solid stock material as by machining, die casting, upsetting, or other similar manufacturing process, to include at the rear end 12 thereof having a terminal portion 14 adapted to receive the bared end of an electrical connector for crimping or soldering connection thereto.

The socket contact 10 at its other, forward end is provided with a generally cylindrical projection 16 adjacent to a larger diameter locating shoulder 18. A retention shoulder 19 is formed intermediate either end of the socket body 10. Since the socket body 10 is formed by relatively precision processes, such as machining, the retention shoulder 21 is accurately sized and located, and possesses a relatively high degree of strength and rigidity.

The socket body 10 is constructed of an electrically conductive material, and for crimping to the electrical conductor, may advantageously be constructed of brass, with a suitable surface processing or plating to prevent corrosion.

The projection 16 includes a forward, relatively larger diameter section 20 at the forward end the socket body 10, with an intermediate groove 22 machined or otherwise formed therein. A chamfer 24 may also be provided at the front end of the projection 16.

The projection 16 also includes a reduced diameter section 26 intermediate the larger diameter section 20 and the locating shoulder 18.

Figure 2:
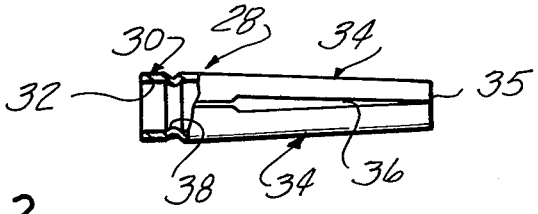
FIG. 2 is a partially sectional view of a tubular spring member formed according to the teachings of the present invention.

Referring to FIG. 2, the spring member 28 is separately manufactured as by forming sheet metal or by drawing or other similar manufacturing methods to provide the generally tubular spring member 28. Adjacent to the rear end 30 of the spring member 28 is an internal diameter 32, which is sized to be fit over the larger diameter section 20 of the socket body 10. The other or forward end is provided with a series of two or more spring fingers 34 formed by a plurality of slots 36 extending axially towards the rear end 30 of the spring member 28. The spring members 24 are readily convergent such as to be enabled to exert a spring force on a mating pin contact (not shown) in a manner well known to those skilled in the art.

The spring member 28 is also provided with a circumferential crimp 38 extending radially inward from and adjacent to the internal diameter 32 at the rear end 30 of the spring member 28. This is employed in cooperation with the groove 22 as a locating feature at assembly, and to improve the electrical connection.

The spring member 28 may be manufactured from beryllium copper or other similar material with a suitable plating thereof such as gold plating, applied to improve the surface conductivity thereof in a manner well known to those skilled in the art.

Figure 3:
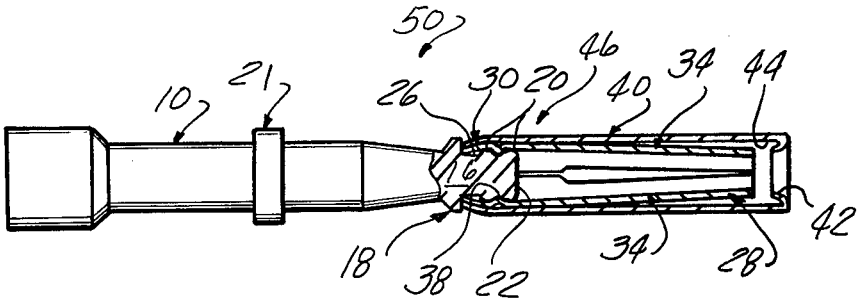
FIG. 3 is a partially sectional view of a socket contact employing the socket body and spring member shown in FIGS. 1 and 2 respectively.

FIG. 3 depicts the assembly of the socket body 10 to the spring member 28 and an outer guide sleeve 40 to form a completed socket contact 50.

The guide sleeve 40 is formed to be of tubular construction, having a guide taper 42 adapted to guide the insertion of the pin contact (not shown). The internal surface 44 acts to provide an outer limit for the radial deflection of the spring fingers 34 to protect the same against excessive deflection as described above. The guide sleeve 40 may be constructed of suitable noncorrosive rigid metallic material, such as stainless steel.

The spring member 28 is first assembled to the socket member 10, having its internal diameter 32 fit over the forward section 20 of the projection 16 and extending axially over the reduced diameter section 26 and having its rear end located against the locating shoulder 18. In this position, the circumferential crimp 38 is interfit into the groove 22 to maintain the spring member 28 position in abutment with the locating shoulder 18 and extending over the reduced diameter section 26 of the projection 16. The annular circumferential crimp 38 and groove 22 provides a secure location of the spring member 28 over the projection 16 during assembly.

The guide sleeve 40 is then assembled over the spring member 28 having its rear end 46 fit over the rear end 30 of the spring member 28, such as to also extend over the reduced diameter section 26. Assembly of the socket contact 50 is completed by a simultaneous crimping radially inward each of the ends 46 and 30 of the tubular spring member 28 and guide sleeve 40 respectively.

This establishes a very secure mechanical connection of the guide sleeve 40 and spring member 28 to the socket body 10. At the same time, a very reliable electrical connection is established between the spring member 28 and the socket body 10, which is enhanced by the contact of the circumferential crimp 38 and groove 22 to thus provide a strong mechanical joinder and reliable electrical connection therebetween, without involving complex assembly steps.

At the same time an accurately located and rigid retention shoulder 21 is afforded by the separate machined construction of the socket body 10.

Many alternate construction materials and details of construction are of course possible such as the use of alternate materials from those described.

Having described the invention what is claimed is:

1. A socket contact for an electrical connector comprising a generally cylindrical conductive socket body formed with a rear end, that includes a terminal portion adapted to receive the bared end of an electrical conductor, said socket body also formed with a forward end that includes a generally cylindrical projection; a conductive tubular spring member having an internal diameter at one end received over said generally cylindrical projection to be fit thereto, and slotted to form spring fingers; and a tubular guide sleeve received over both said spring member and said cylindrical projection characterized by said cylindrical projection being formed with a reduced diameter section and a larger diameter section adjacent thereto at the outer end thereof, with both said one end of said spring member and one end of said guide sleeve crimped radially inward towards said reduced diameter section to secure said spring member and guide sleeve to said socket body, said larger diameter section of said cylindrical projection formed with an intermediate groove and wherein said spring member is formed with a circumferential crimp received into said groove to improve the electrical connection therebetween and provide a locating feature at assembly.

2. A socket contact as claimed in claim 1 characterized in that said socket contact is formed with a retention shoulder intermediate said terminal portion and said cylindrical projection.

3. The socket contact according to claim 1 characterized in that said socket body is formed with a locating shoulder adjacent said projection abutting said one end of said spring member, and one end of said guide sleeve to provide an endwise location thereof.

4. A method of manufacturing a socket contact for an electrical connector comprising the steps of forming from conductive material a generally solid cylindrical socket body having a terminal portion at a rear end adapted to receive the bare end of an electrical conductor to be joined thereto, and forming said socket body with a generally cylindrical projection at the forward end;

forming of said socket body formed with a groove intermediate said larger diameter section, and forming said spring member with a circumferential crimp adjacent said one end thereof extending radially inward from said internal diameter;

forming a tubular spring member configured with an internal diameter at a rear end adapted to be fit over said projection and formed with slots at the forward end thereof to provide spring fingers;

forming a tubular guide sleeve having an inside diameter configured to be fit over said spring member;

assembling said spring member onto said projection of said socket body with said internal diameter fit over said projection and with said crimp disposed in said intermediate groove in said larger diameter section of said projection;

assembling said guide sleeve over said spring member with said rear end thereof fit over and axially aligned with said rear end of said spring member, characterized by the steps of forming said projection with a larger diameter section at the forward end of said projection and an adjacent reduced diameter section and the step of simultaneously crimping each of said rear ends of said spring member and guide sleeve respectively radially inward towards said reduced diameter section of said projection to secure said spring member and guide sleeve to said socket body.

* * * * *